United States Patent [19]

Brown et al.

[11] 4,120,508

[45] Oct. 17, 1978

[54] WHEELED SKATEBOARDS

[76] Inventors: John Steven Brown, 1141 Humbolt St.; Thomas Gerald Hillard, 1628 4th St., both of Santa Rosa, Calif. 95404

[21] Appl. No.: 782,916

[22] Filed: Mar. 30, 1977

[51] Int. Cl.[2] ..... A63C 17/02

[52] U.S. Cl. ..... 280/11.28; 280/87.04 A

[58] Field of Search ..... 280/87.04 R, 87.04 A, 280/11.27, 11.28, 11.2, 11.21, 11.23, 11.19, 109, 11.1 R, 11.1 BT, 11.1 BR

[56] References Cited

U.S. PATENT DOCUMENTS

| | | | |
|---|---|---|---|
| 329,829 | 11/1885 | Griffiths | 280/11.27 |
| 1,406,642 | 2/1922 | Hardy | 280/11.19 |
| 1,885,158 | 11/1932 | Vogt | 280/11.28 |
| 2,097,721 | 11/1937 | Cledina | 280/87.04 R |
| 2,424,072 | 7/1947 | Allred | 280/11.28 |
| 2,474,946 | 7/1949 | Kinslow | 280/87.04 R |
| 2,552,035 | 5/1951 | Cooke et al. | 280/11.28 |
| 2,676,812 | 4/1954 | Owsen et al. | 280/11.28 |
| 3,039,784 | 6/1962 | Davis | 280/87.04 R |
| 3,729,207 | 4/1973 | Reynolds | 280/11.2 |
| 3,856,321 | 12/1974 | Solymosi | 280/87.04 R |

*Primary Examiner*—David M. Mitchell

*Attorney, Agent, or Firm*—Berman, Aisenberg & Platt

[57] ABSTRACT

Wheeled skateboards which in one embodiment includes a novel wheeled truck adjustment for the turning radius of the skateboard to any desired value. The invention may be applied to either standing or sitting skateboards, and certain embodiments provide shock absorbing properties for the wheeled trucks, independent adjustment of the front and rear trucks on a skateboard, and adjustment to the wheel axle position on each truck.

14 Claims, 20 Drawing Figures

FIG. 9.
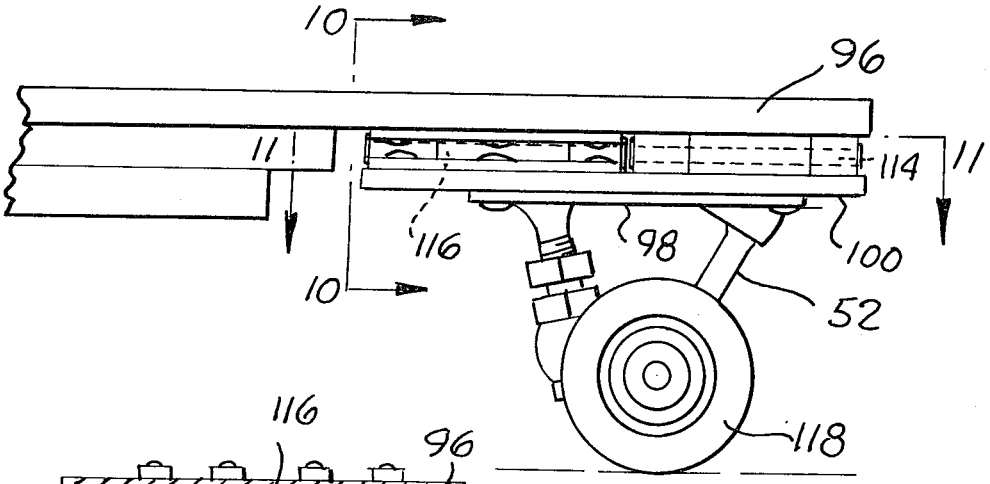
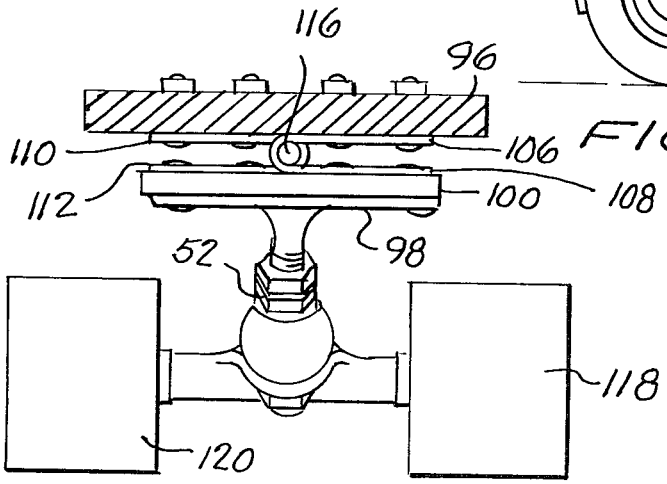
FIG. 10.
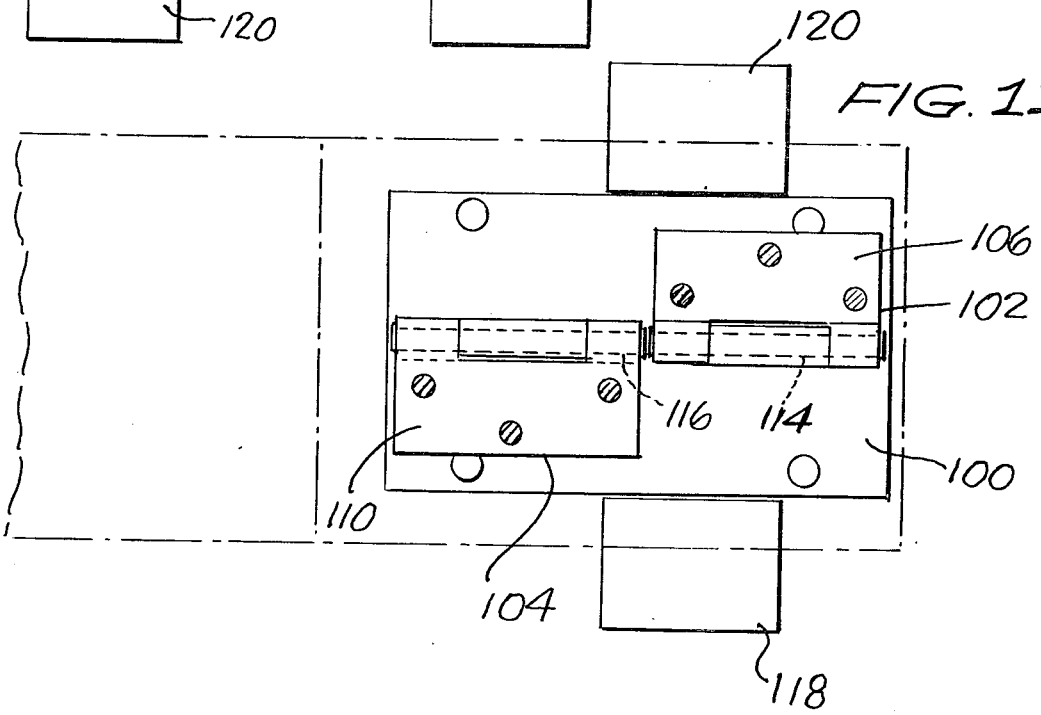
FIG. 11.

WHEELED SKATEBOARDS

BACKGROUND OF THE INVENTION

1. Field of the Invention

The present invention is related generally to skateboards and, more particularly, is directed towards skateboards which incorporate means for controlling and adjusting the turning of same to increase versatility and performance.

2. Description of the Prior Art

Skateboards are well-known in the art. Most skateboards presently in use consist of an upper, horizontal board member to the underside of which are connected front and rear wheeled trucks. In use, a rider places one or both feet on the upper surface of the horizontal board member, and the truck designs generally permit the board to be steered by leaning same either to the right or to the left.

Sitting skateboards are a relatively recent phenomena and are designed to permit the rider to either sit or recline on the top of the board during use. The sitting or reclining position decreases the resistance to wind to enable such skateboards to be operated at higher speeds. Frequently, therefore, sitting skateboards are utilized as racing skateboards.

The sitting skateboards are also turned by leaning in the intended direction of travel. The forward and rear wheeled trucks of both sitting and standing skateboards are generally arranged in such a fashion that the front wheels pivot in the direction of the desired turn, while the rear wheels pivot in the opposite direction. A frequent problem encountered with prior known skateboards occurs when the rider inadvertently begins to steer the skateboard more with the rear wheels than the front ones. This tends to produce wobbling in the board and can lead to loss of control and stability. It would therefore be quite useful if there were some way of controlling or limiting the turning action inherent in known rear wheeled trucks on such skateboards in order to eliminate such wobbling tendencies and instabilities.

Another problem with prior art sitting skateboards concerns the provision of a suitable seat means or support upon which the rider may either sit or recline while maintaining good control over the board. Inasmuch as turning is controlled by tilting the seat to the left or the right, and due to the fact that such seats are known to rest close to the ground, the prior art seats have been limited by virtue of the tendency for the sides of the seat to touch the ground while turning. This, naturally, both slows down the speed and limits the turning action available from the board, in addition to being potentially dangerous.

The prior art wheeled trucks utilized in connection with both standing and sitting skateboards have generally been of a non-adjustable variety wherein a given tilt of the skateboard resulted in a given turning radius of the truck. While such predictable performance is sometimes desirable, it would be very advantageous if the turning radius of wheeled trucks could be adjustable from a very large radius approaching no turn, to a very small turning radius, and if the front and rear trucks could be made independently adjustable.

Previously known skateboard trucks are also relatively rigid in structure and are thus unable to absorb shocks readily. Additionally, such trucks have fixed position axles which can be detrimental if optimum performance is desired.

Prior art United States patents which are related to skateboards, wheeled trucks, or the like, include: U.S. Pat. Nos. 2,097,721; 2,474,946; 3,039,784; 3,729,207; and 3,856,321.

OBJECTS AND SUMMARY OF THE INVENTION

It is therefore a primary object of the present invention to provide a novel and unique skateboard and truck which overcome all of the disadvantages noted above with respect to prior art devices.

An additional object of the present invention is to provide a novel and unique skateboard which incorporates means for eliminating the wobble inherent in prior art designs which occurs by virtue of inadvertent oversteering of the rear wheeled trucks with respect to the front wheeled trucks.

Another object of the present invention is to provide a novel sitting or standing skateboard which includes means for limiting the turning action of the rear wheels.

A still further object of the present invention is to provide a novel wheeled skateboard truck which has means that permits adjustment of the turning radius of the skateboard thereof from no turn to a very large radius to a very small radius.

Another object of the present invention is to provide a wheeled truck which permits the turning radius thereof to be adjustable over a wide range, and which further has shock absorbing properties and means for permitting selection of the desired axle position for optimum performance.

An additional object of the present invention is to provide a skateboard with novel front and rear wheeled trucks whose turning radii are independently adjustable.

The foregoing and other objects are attained in accordance with one aspect of the present invention through the provision of a sitting or standing skateboard which comprises a front support having a first standard wheeled truck connected to the underside thereof, a rear support having a second standard wheeled truck connected to the underside thereof, and a central section positioned between the front and rear supports. Means are provided for limiting the turning of the second wheeled truck in response to the tilting of the central section by the rider. The turn limiting means may take any of a number of different forms. In one embodiment, the turn limiting means comprises an additional rear support member positioned between the central section means and the rear support member and pivotally connected to the latter. The additional rear support member is rigidly attached to the central section so as to move therewith, and an elongate pivot rod is connected between the additional rear support member and the rear support member. In a refined form, the rear support members may be substantially coplanar, and the pivot rod extends through the central portions thereof so as to define a longitudinal pivot axis. Means may also be provided for adjusting the inclination of the rear support member in response to a particular inclination of the additional rear support member. The adjusting means may comprise means for tightening or loosening the pivot bolt in order to adjust the friction fit between the two rear support members.

In accordance with an alternative embodiment of the turn limiting means, the rear support member may be positioned below and substantially parallel to the additional rear support member. Means may be positioned between the two rear support members for pivotally interconnecting same which, in a preferred form, comprises hinge means having a pivot axis parallel to the longitudinal center line of the skateboard.

In accordance with a further alternative embodiment of the present invention, the turn limiting means may comprise a truck support plate connected to the underside of the rear support member, flange means depending downwardly from the plate, and a rear wheel axle support means which includes a flange that is adapted to be pivotally connected to the first-named flange means. The axis of the pivotal connection is substantially parallel to the longitudinal axis of the skateboard, whereby tilting of the central section will not turn the rear wheels. More particularly, the flange means comprises a pair of parallel, spaced flanges adapted to pivotally receive the flange of the rear wheel axle support means therebetween. The parallel, spaced flanges are preferably substantially perpendicular to the truck support plate.

In accordance with yet another alternative embodiment of the present invention, there is provided a novel wheeled truck which includes means for adjusting the turn response of the skateboard from a minimum to a maximum turning radius. The turn response adjusting means, which are preferably provided to both the front and rear of the skateboard to permit independent adjustment thereof, more particularly comprises means for supporting the substantially horizontal axle of the wheels, means for supporting the axle supporting means about a first pivot axis, and means pivotally connected between the axle supporting means and the means for supporting same for adjusting the degree of movement of the axle supporting means in response to a tilting of the skateboard.

In accordance with more specific aspects of the present invention, the rear wheel axle supporting means comprises a substantially U-shaped support member having a pair of vertical flanges through which the wheel axle extends, and a horizontal member connecting the flanges and pivotally mounted about the first pivot axis. The means for supporting the axle supporting means preferably comprises a support plate mounted to the underside of the skateboard and having a first shaft extending downwardly therefrom. More particularly, the last-named means preferably comprises a yoke member having a pair of arms pivotally mounted to the U-shaped support member and a pivot stud having means for fixably positioning same to the support plate associated therewith. The support plate preferably includes a curved portion extending downwardly from the skateboard that includes aperture means formed therein for receiving and securing the means for fixedly positioning the pivot stud. Resilient bushing means are also provided which are preferably mounted on the first shaft on both sides of the horizontal connecting member of the U-shaped axle support. The last-named resilient bushing means provides shock absorbing properties to the truck.

In accordance with still other aspects of the present invention, there is provided a novel wheeled truck which has shock-absorbing properties incorporated therein. More particularly, the wheeled axle of the truck is supported by a frame member which is, in turn, resiliently mounted between a pair of rubber bushings to the underside of the skateboard. Means are also provided for adjusting the compression of the bushings such that the shock absorbing tendency of the truck may also be adjusted.

A still further aspect of the present invention provides wheeled truck means which permits selection of the position of the axle of the wheels from among a plurality of available positions for optimizing performance.

BRIEF DESCRIPTION OF THE DRAWINGS

Various objects, features and attendant advantages of the present invention will be more fully appreciated as the same becomes better understood from the followingdetailed description of the present invention when considered in connection with the accompanying drawings, in which:

FIG. 9 is a side, plan, partially broken view of an alternative embodiment of a turn limiting means for a wheeled truck in accordance with the present invention;

FIG. 10 is a cross-sectional view of the alternative embodiment illustrated in FIG. 9 and taken along line 10—10 thereof;

FIG. 11 is a sectional view of the preferred embodiment illustrated in FIG. 9 and taken along line 11—11 thereof;

DETAILED DESCRIPTION OF THE PREFERRED EMBODIMENTS

Figures 1, 2, 3:
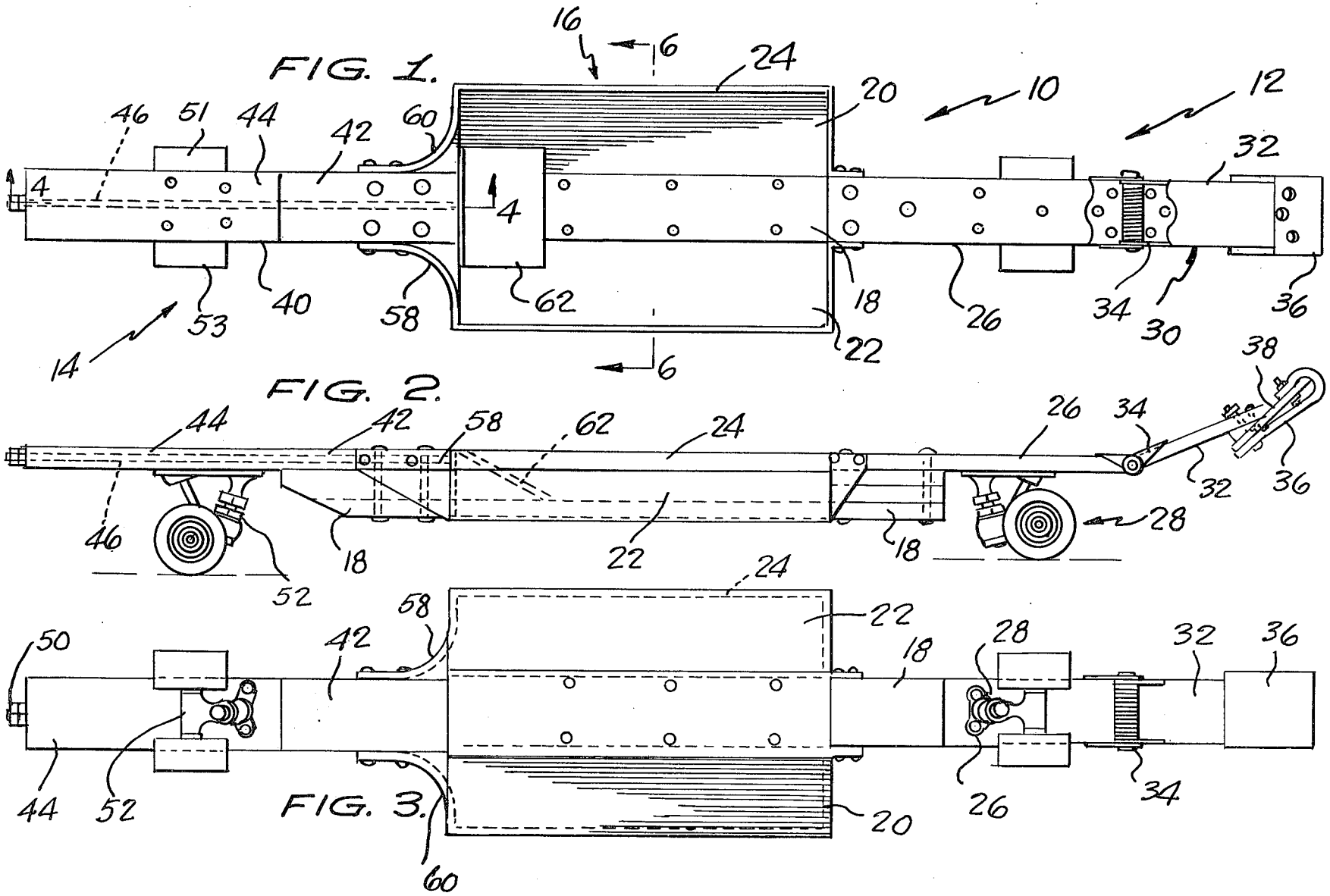
FIG. 1 is a top, plan view of a preferred embodiment of a sitting skateboard in accordance with the present invention.
FIG. 2 is a side view in elevation of the preferred embodiment illustrated in FIG. 1.
FIG. 3 is a bottom view of the preferred embodiment illustrated in FIG. 2.

Referring now to the drawings, wherein like reference numerals indicate identical or corresponding parts throughout the several views, and more particularly to FIGS. 1 through 3 thereof, a preferred embodiment of a skateboard illustrating one aspect of the present invention is indicated generally by reference numeral 10. Skateboard 10 includes a front end indicated generally by reference numeral 12, a rear end indicated generally by reference numeral 14, and a central section which may include a seat 16 upon which the rider may either sit or lie on his back. Although, for ease in explanation, the following description of the present invention is set forth in connection with a sitting skateboard such as is illustrated in FIGS. 1–3, it will be appreciated that the principles of the invention are equally applicable to standing skateboards.

The central section or seat portion 16, which may, for example, be molded of fiberglass, formed of wood, sheet metal, or like material, includes a lower-most central portion 18 running longitudinally and of approximately the same width as the front and rear ends 12 and 14, respectively.

Figure 6:
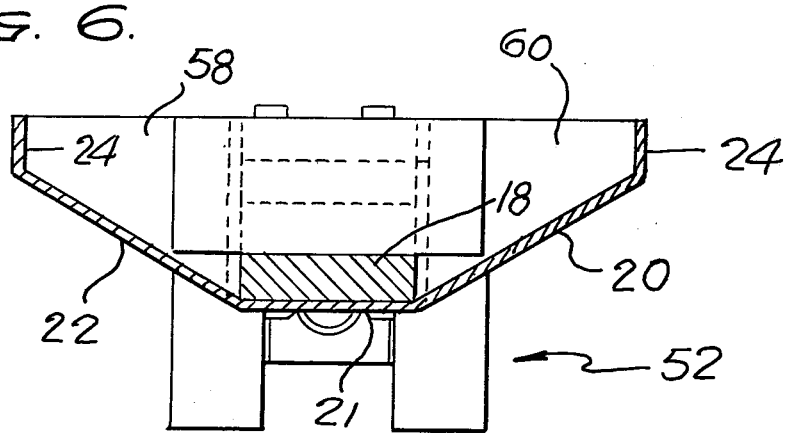
FIG. 6 is a cross-sectional view illustrating a preferred embodiment of seating means illustrated in FIG. 1 and taken along line 6—6 thereof.

As also illustrated clearly in FIG. 6, the seat 16 includes a bottom portion 21 positioned underneath the central portion 18, and a pair of side portions 20 and 22 which extend upwardly from the bottom portion 21. Side portions 20 and 22 are preferably angled at approximately a 160° angle to the horizontal. Extending upwardly from the upper edge of said portions 20 and 22 is an upstanding rim 24 which is substantially perpendicular to the ground.

Referring back to FIGS. 1 through 3, the front portion 12 of the skateboard 10 includes a front main frame member 26 of substantially the same width as the central portion 18 and which is clamped thereto by bolt means as clearly illustrated in FIG. 2. Fastened to the underside of front main frame member 26 is a standard wheeled truck 28 which includes a pair of spaced wheels mounted on an axle supported by a ball-joint support mechanism, a structure which is standard and forms no part of the present invention. The construction of the standard wheeled truck 28 is such so as to permit a turning movement to be effectuated by leaning the front main frame member 26 to the right or left so as to achieve a right or left turn, respectively, as will be apparent to a person of ordinary skill in this art.

Positioned forwardly of the front main frame member 26 and indicated generally by reference numeral 30 is a foot operated brake which comprises a pivot member 32 pivotally attached to the front end of main frame member 26 via a spring-loaded hinge 34. The hinge 34 is spring-loaded so as to bias the pivot member 32 upwardly as shown in FIG. 2. A rubber slat or like member 36 is mounted to a support plate 38 which, in turn, is connected as by bolts to the forward end of pivot member 32. The brake 30 is intended to be operable by one foot of a rider and achieves braking by the frictional contact between rubber slat 36 and the ground upon the depression of the former against the action of biased spring hinge 34.

Figure 4:
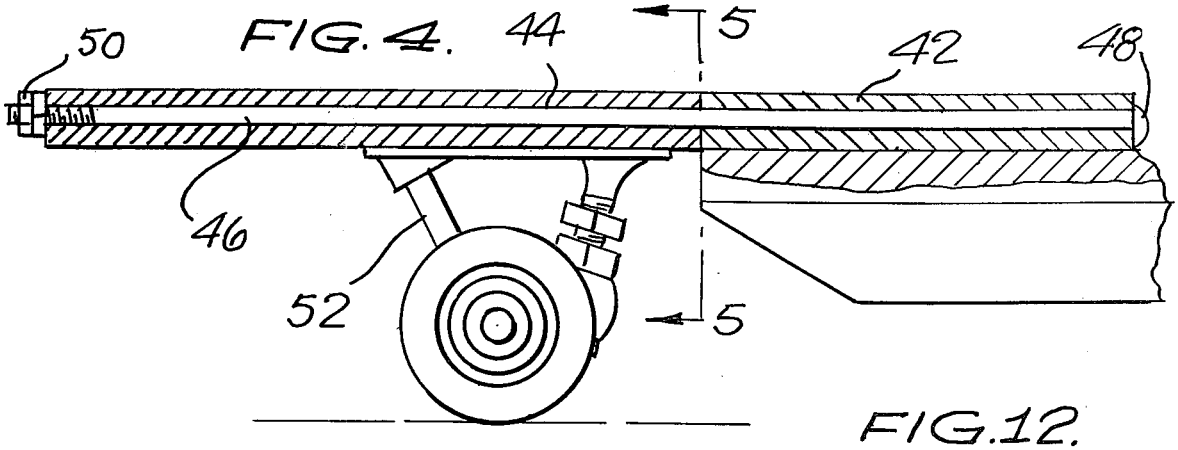
FIG. 4 is an enlarged, sectional view of a preferred embodiment of a limited rear truck turning means in accordance with the teachings of the present invention, taken along line 4—4 of FIG. 1.
Figure 5:
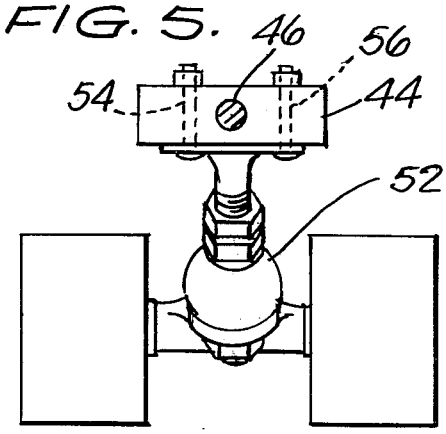
FIG. 5 is a cross-sectional view of the preferred embodiment illustrated in FIG. 4 and taken along line 5—5 thereof.

The rear end 14 of the sitting skateboard 10 preferably includes means for limiting the turning of the rear truck 52 in order to minimize the possibility of wobble. The turn limiting means, indicated generally by reference numeral 40, consists of a forward support member 42 and a rear support member 44 which are aligned coplanar with one another. Forward and rear support members 42 and 44, as illustrated more clearly in FIGS. 4 and 5, are pivotally interconnected by a longitudinal bolt 46 having a head 48 and a threaded end to which is secured nut 50. The degree to which the bolt 46 is tightened by nut 50 determines the relative friction between the forward and rear support members 42 and 44, respectively, which, in turn, determines the degree of freedom to which the forward support 42 may be laterally tilted without affecting tilting of the rear support 44. In other words, since the turning action of the truck 52, which includes rear wheels 51 and 53, is provided by tilting the rear support 44, one way in which to prevent the rear wheels 51 and 53 from turning is to provide a bifurcated rear support 42 and 44 which would permit forward portion 42 to turn with seat member 16 while simultaneously permitting rear support 44 to remain level. Again, the degree of turning of the rear end 14 may be adjusted by tightening or loosening the bolt 46 via nut 50, or the like. The standard wheeled truck 2 is mounted to the underside of rear support 44 via a plurality of bolts such as 54 and 56.

Referring back to FIGS. 1 through 3, the seat 16 includes inwardly curving rear portions 58 and 60 of the side members 20 and 22 which fasten to the forward support 42 of the rear end 14. The front portions of side portions 20 and 22 are fastened to the front main frame member 26 in a similar fashion. A backrest support plate 62 may also be provided towards the rear of the seat 16 as illustrated.

Figure 7:
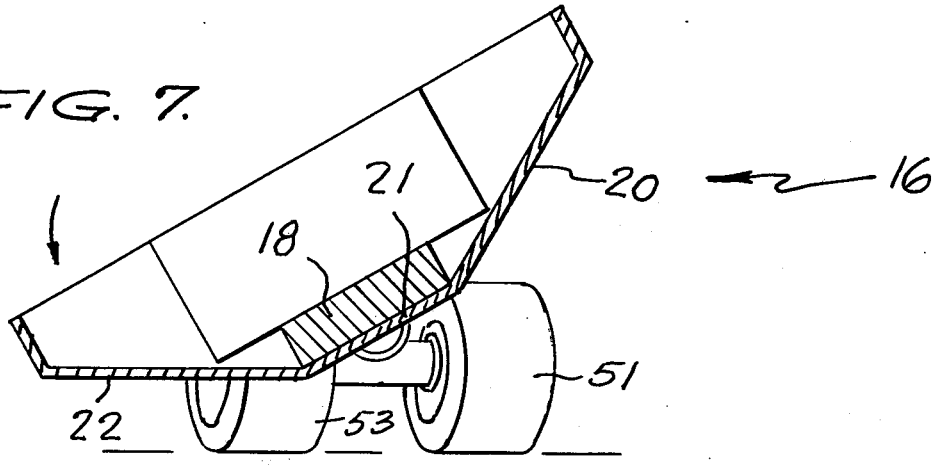
FIG. 7 is a view of the apparatus illustrated in FIG. 6 but shown in an operative, tilted position.
Figure 8:
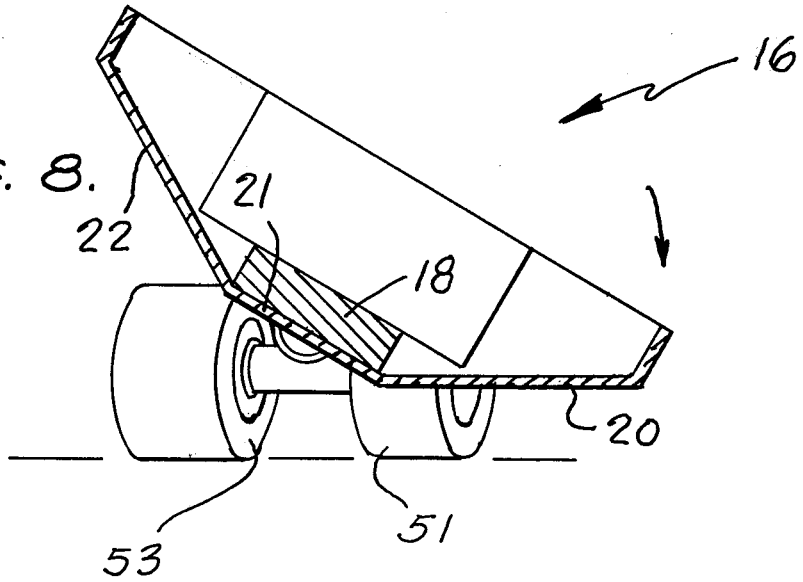
FIG. 8 is a view similar to that shown in FIG. 7 but tilted in the opposite direction.

In operation, in contrast to a standing skateboard, the rider of a sitting skateboard either sits or lays on his back on the seat 16 of skateboard 10. The rider places one foot on the front of the board, for example, on frame member 26, just behind brake 30, which foot is used to operate the brake when necessary. The other foot of the rider is preferably extended straight ahead alongside front frame member 26. If braking or hard cornering are not anticipated, both feet may be extended straight ahead to reduce wind resistance. The rider may sit in the lowered midsection 16 of the board. To further lower his center of gravity and decrease wind resistance, the rider may lie with his buttocks supported by the two side sections 20 and 22 with his back supported by the rear section 14 of the board. In a preferred embodiment, the lower-most central portion 18 and the underlying bottom 21 of the seat are approximately three inches wide, and side portions 20 and 22 are formed at an approximate 160° angle to the horiontal. The bottom portion 21 of the seat is approximately one-half inch off of the ground. With such parameters, the seat may be tilted as illustrated in FIGS. 7 and 8 to steer either to the right or the left, respectively (moving forwardly), to a maximum angle of approximately 20°. The length of the side members 20 and 22 could be increased to any desirable length without decreasing the maximum angle of tilt. The V-shape of the seat tends to help keep the rider centrally positioned so as to achieve maximum stability.

For the sake of clarity, FIGS. 7 and 8 indicate the turning action of rear wheels 51 and 53 in response to a tilting of the seat 16 without the provision of the limited turning rear truck 40 of the present invention. It will be understood that the provision of such limited turning means, as described hereinabove, will limit the ability of wheels 51 and 53 to pivot as illustrated in FIGS. 7 and 8 in response to a tilting of seat 16. The positions of the seat 16 in FIGS. 7 and 8 illustrate that sides 20 and 22 are parallel to the ground upon maximum tilt of the board 18.

An alternative embodiment of a limited turning rear section is illustated in FIGS. 9 through 11, to which attention is now directed. In FIGS. 9 through 11, the previously described rear portions 42 and 44 of FIGS. 1 through 5 have been replaced by a single rear section 96 which is connected at its front portion to the seat 16. In the construction of FIGS. 9 through 11, a standard wheeled truck 52 has an upper plate 98 which is bolted or otherwise connected to the underside of an auxiliary pivot piece 100. Pivot piece 100, which may, for example, be formed of plywood or the like, has mounted on its upper surface a pair of hinges 102 and 104 whose pivot axes, defined by respective pivot pins 114 and 116, are positioned colinearly. Reference numerals 106 and 108 indicate the upper and lower flanges of rearwardly positioned hinge 102, while reference numerals 110 and 112 indicate the upper and lower flanges of forwardly positioned hinge 104, while the wheels of the rear truck 52 are indicated by reference numerals 118 and 120.

The arrangement described in connection with the embodiment illustrated in FIGS. 9 through 11 enables a rider to tilt the skateboard seat, to which rear section 96 is rigidly attached, and thus turn the front wheels 28 of the board without turning the rear wheels 118 and 120 whatsoever in maneuvering relatively mild corners. In sharper corners, however, the rear wheels 118 and 120 will begin to turn when the rear section 96 makes contact with the edge of the auxiliary pivot piece 100. In any event, the rear wheels 118 and 120 will be turning comparatively less than the wheels of the front truck 28, to permit the latter to provide the main turning action, as is desired.

Figure 12:
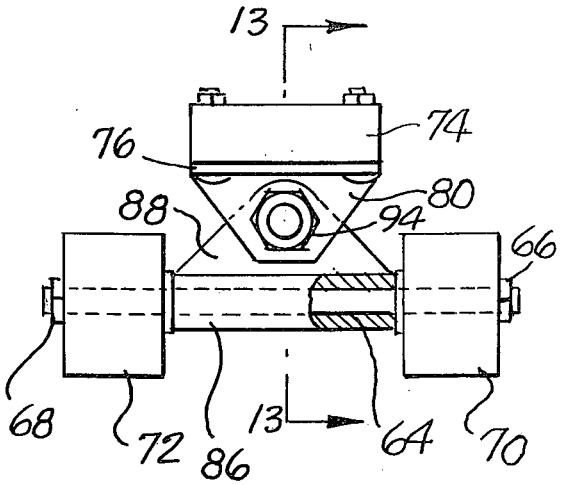
FIG. 12 is a rear-plan view, partially broken, of yet another alternative embodiment of a wheeled truck turn limiting means in accordance with the teachings of the present invention.
Figure 13:
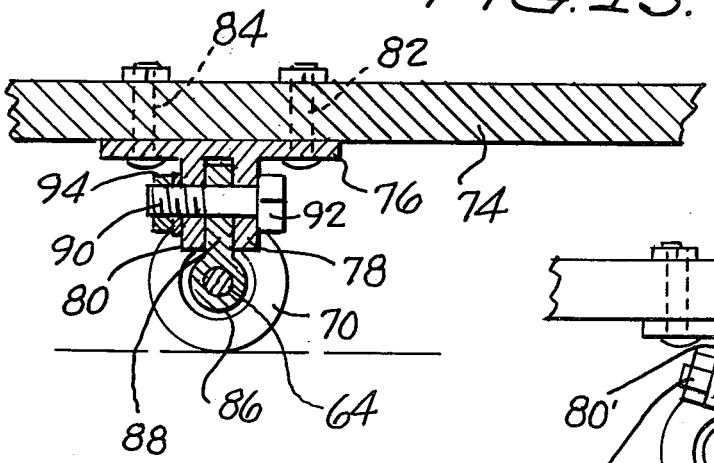
FIG. 13 is a sectional view of the embodiment illustrated in FIG. 12 and taken along line 13—13 thereof.

Referring now to FIGS. 12 and 13, there is illustrated an alternative embodiment of a truck which may be utilized as the rear wheeled truck in conjunction with the present invention which will not turn in response to tilting of the seat of the skateboard. In the embodiment of FIGS. 12 and 13, the dual rear sections 42 and 44 of FIGS. 1 through 5 have been replaced by a single rear board 74 connected directly and movable with the seat 16 of skateboard 10. A plate 76 is mounted to the underside of board 74 via bolts 82 and 84 and has a pair of downwardly depending, parallel flanges 78 and 80, which are somewhat triangular in plan view (FIG. 12). The wheels 70 and 72 of the truck are mounted on the respective ends of a continuous axle 64 and are held in place by nuts 66 and 68, respectively, The truck assembly further includes a axle support 86 mounted about axle 64 and having an upwardly extending flange 88 which is sized and positioned between flanges 78 and 80. A pivot bolt 90 having a head 92 and secured by a nut 94 extends through aligned apertures in flanges 78, 80 and 88 to form a pivot for board 74.

In contrast to the prior truck embodiments, the embodiment of FIGS. 12 and 13 serves to maintain the wheels 70 and 72 straight regardless of the angle of inclination of board 74. That is, the rear truck illustrated in FIGS. 12 and 13 does not turn in response to a tilting of the board 74. When this truck is used, all turning will therefore be achieved by the front truck 28 of board 10. Resistance to leaning of the skateboard 10 may be adjusted by either tightening or loosening the nut 94 of bolt 90.

Figure 14:
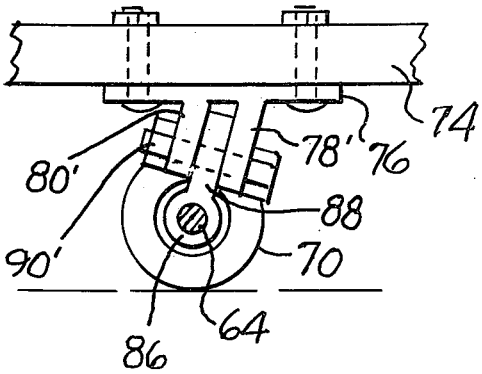
FIG. 14 is a side, plan view of a modified alternative embodiment of the apparatus depicted in FIGS. 12 and 13.

FIG. 14 illustrates a modification of FIGS. 12 and 13 wherein the parallel flanges 78' and 80' are slightly inclined with respect to the vertical. This inclination permits a limited turning of the rear wheels in response to a tilting of the board 74. The limited turning is achieved as a result of the tendency of one wheel 70 to step in front of the other 72 when the board 74 is tilted by virtue of the axis of the turning bolt 90' being nonparallel with the center line of the main board 74.

Referring now FIGS. 15 through 20, there is illustrated an alternative embodiment of a wheeled truck which permits, in contrast to the prior embodiments, adjustment of the turning radius of the wheels 145 and 155 thereof. The truck illustrated in FIGS. 15 through 20 further has shock absorbing properties, as will become more clear hereinafter. Reference numeral 122 refers to the skateboard to the underside of which is connected, by any suitable means, a mounting plate 124. Mounting plate 124 preferably includes a curved, downwardly extending rear portion 126. Curved portion 126 preferably has aperture means, such as slot 128, formed centrally therein, for a purpose to become more clear hereinafter. Slot 128 could alternatively comprise a plurality of individual holes or apertures, with substantially equivalent results, as will become clear.

Rigidly mounted to the underside of plate 124 is a support block 130 which serves the function of a spacing member. Support block 130 may be centrally threaded so as to receive a mounting shaft or stud 132 that may be positioned substantially vertically so as to define a pivot axis.

Also mounted on shaft 132 is a U-shaped wheel axle support frame 134. Wheel axle support frame 134 includes a pair of vertical, substantially parallel, spaced side flanges 138 and 136 which are rigidly connected by a horizontal connecting member 140.

Figure 15:
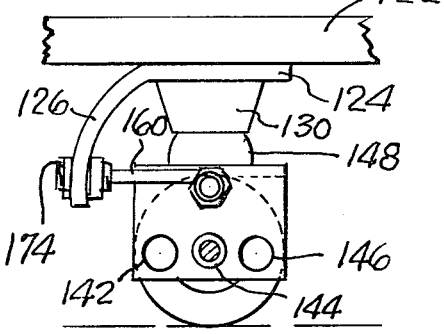
FIG. 15 is a side, plan view of a preferred embodiment of a wheeled truck which includes means for adjusting the turning radius thereof.
Figure 16:
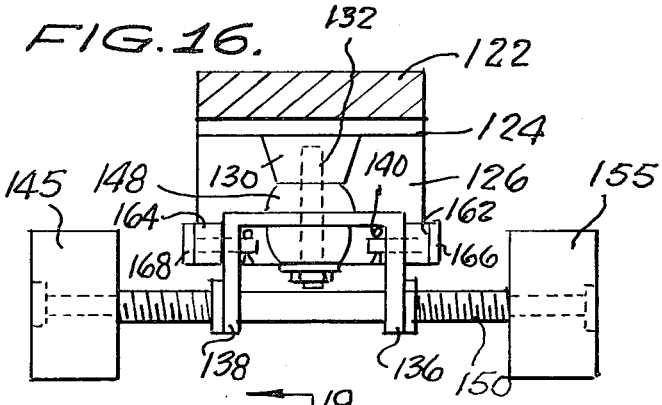
FIG. 16 is a front view of the preferred embodiment illustrated in FIG. 15.
Figure 18:
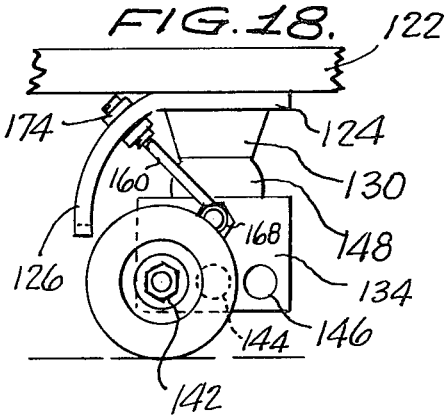
FIG. 18 is a side view of substantially the same embodiment illustrated in FIG. 15 but shown in a different operative position.
Figure 17:
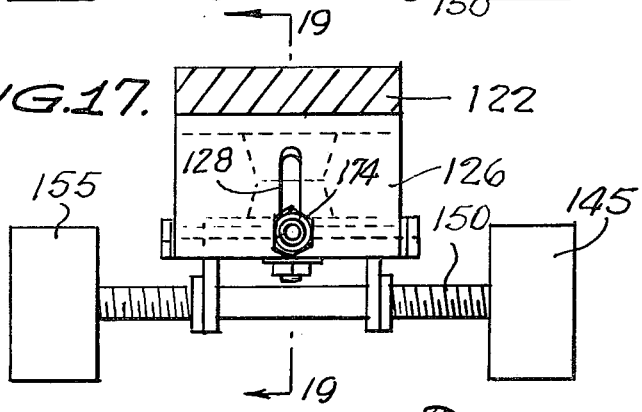
FIG. 17 is a rear view of a preferred embodiment illustrated in FIG. 15.

Each of the side flanges 136 and 138 preferably includes a plurality of possible axle mounts 142, 144 and 146, which are aligned in opposed flanges 136 and 138. FIGS. 15 and 16 illustrate wheel axle 150 positioned through the central pair of axle mounts 144, while FIG. 18 illustrates a possible alternative mounting of a wheel axle through the rear pair of mounts 142.

Positioned between horizontal connecting member 140 and support block 130 in a resilient cushion 148 which may be formed, for example, of rubber. Below the horizontal connecting member 140 and mounted on shaft 132 is a second resilient cushion 152, which may also be formed of rubber or the like. The rubber cushions 148 and 152, as well as the U-shaped wheel axle support frame 134 are all secured to the support block 140 by virtue of a washer 154 and a nut 156 threaded onto the other end of mounting stud 132, as illustrated clearly in FIG. 19.

Figure 20:
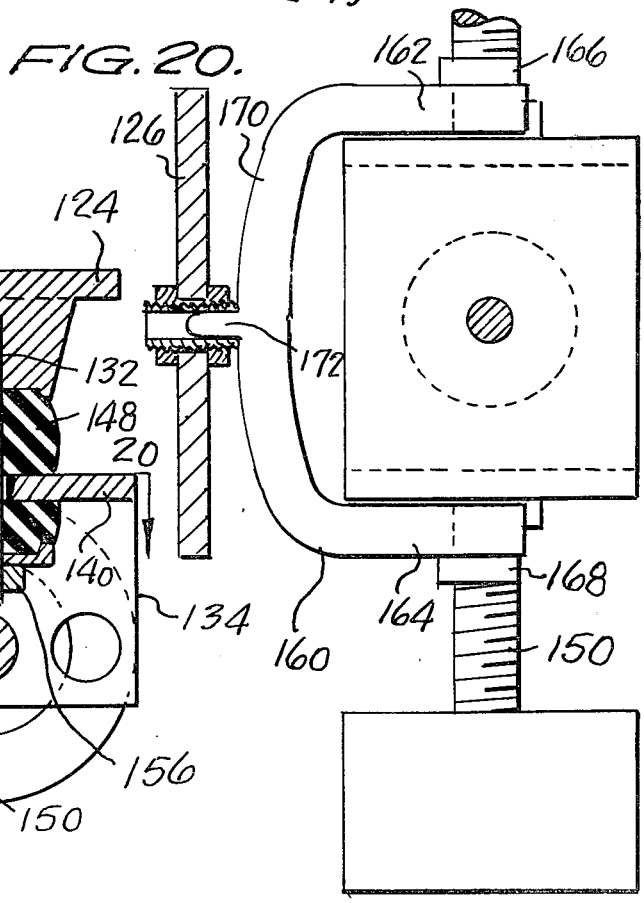
FIG. 20 is a sectional view of the preferred embodiment illustrated in FIG. 19 and taken along line 20—20 thereof.
Figure 19:
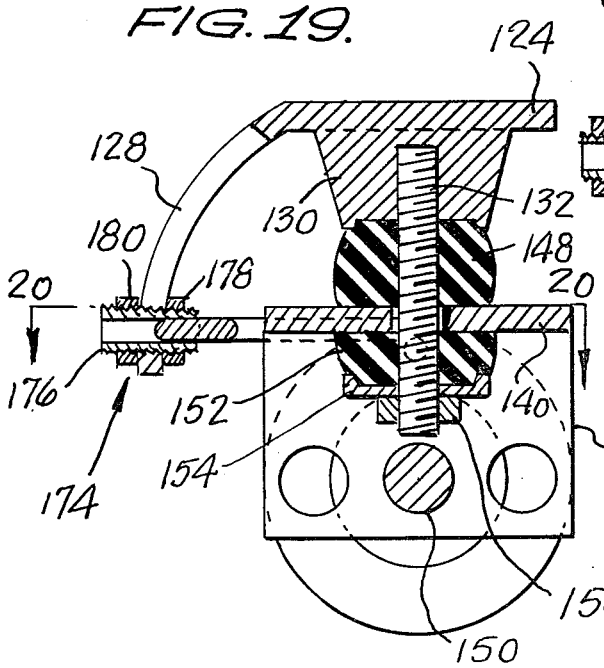
FIG. 19 is a sectional view of the preferred embodiment illustrated in FIGS. 15 through 17 and taken along line 19—19 of FIG. 17.

Pivotally mounted to the support frame 134 is a yoke or pivot frame 160 (FIG. 20). The yoke 160 includes a pair of substantially parallel, coplanar side arms 162 and 164 which are pivotally mounted at their respective ends to the side flanges 136 and 138 of axle support frame 134 via a pair of mounting bolts 166 and 168, respectively. Yoke 160 includes a connecting portion 170 which spans arms 162 and 164. Extending outwardly from the mid-portion of connecting member 170 is a pivot stud 172 which defines a pivot axis for yoke 160 and which is free to rotate within a pivot bushing assembly 174 (FIG. 19).

The pivot bushing assembly 174 may include, for example, an externally threaded sleeve 176 which is positionable within slot 128 at any desired angle. The sleeve 176 may be secured in a desired position in slot 128 by means of a pair of lock nuts 178 and 180. Accordingly, the yoke 160 may be pivotable from a substantially horizontal position illustrated in FIG. 15 to an uppermost position illustrated in FIG. 18, the latter being defined by the upper-most termination of slot 128 in the downwardly extending rear portion 126 of mounting plate 124. In either of the positions illustrated in FIGS. 15 and 18, or in any position in which the pivot bushing assembly 174 is secured intermediate thereof, the pivot stud 172 is free to rotate about its own axis in response to lateral tilting of board 122.

The turning radius of the truck illustrated in FIGS. 15 through 20 may be adjusted by changing the angle of the pivot frame 160 with respect to the horizontal. For example, in the position illustrated in FIG. 15, no turning will occur when the board 122 is tilted. As the yoke 160 is moved upwardly towards the position illustrated in FIG. 18, the turning radius of the truck becomes tighter by virtue of the changing of the plane within which the wheels are able to move from a vertical plane to an inclined plane.

The yoke 160 provides very little support to the wheel axle support frame 134, whose main source of support arises from rubber cushions 148 and 152. The latter design feature results in considerable shock-absorbing properties to the truck assembly in that the axle 150 may move downwards and backwards simultaneously.

The shock-absorption and turning qualities of the truck of the present invention illustrated in FIGS. 15 through 20 may be adjusted by loosening or tightening the nut 156. For example, if nut 156 is tightened, the resilient cushions 148 and 152 will be compressed to limit the shock-absorbing qualities and turning action achievable with a given tilt.

The truck illustrated in FIGS. 15 through 20 may be utilized on either the front or rear of a skateboard, such as on the rear in combination with a standard truck (as illustrated in FIGS. 1 through 3) on the front, or, preferably, on both the front and rear of the skateboard installed such that the cushions of each truck face the center of the board. The latter construction is unique in permitting after-installation independent adjustment of either or both of the turning radii of the front and rear truck assemblies.

The provision of a plurality of axle mounts 142, 144 and 146 on each truck will permit the same construction to be used on both the front and rear of a skateboard. A preferred embodiment has the axle of both the front and rear trucks mounted in their respective most rearward set of mounts. This permits the board to pull rather than push the wheels during forward motion. On the other hand, if extremely tight performance is desired, i.e. shock absorption properties are to be minimized, it is preferred to use the center set 144 of axle mounts which will tend to minimize the torsion exerted on the resilient bushings while turning, in contrast to the other two available axle positions.

Obviously, numerous modifications and variations of the present invention are possible in light of the above teachings. It is therefore to be understood that within the scope of the appended claims, the invention may be practiced otherwise than as specifically described herein.

We claim as our invention:

1. A truck for supporting a pair of wheels connected by an axle and adapted for mounting to the underside of a board, which comprises means for adjusting the turning radius of said pair of wheels in response to a given tilt of said board, said turning radius adjusting means comprising:

means for supporting said axle comprising a substantially U-shaped support member having a pair of vertical flanges through which said axle extends and a horizontal member connecting said flanges;

means for supporting said axle supporting means comprising a support plate adapted to be mounted to the underside of said board and having a shaft defining a first pivot axis and extending downwardly therefrom through said horizontal member; and means pivotally connected between said U-shaped support member and said support plate for permitting adjustment of the degree of movement of said axle supporting means for a given tilt of said board about a second pivot axis which comprises a yoke member having a pair of arms pivotally mounted to said flanges and a pivot stud defining said second pivot axis and having means for selectively positioning same to said support plate.

2. A truck as set forth in claim 1, wherein said support plate further comprises a curved portion adapted to extend downwardly from said board and including aperture means formed therein for receiving said means for selectively positioning said pivot stud.

3. A truck as set forth in claim 2, further comprising resilient bushing means mounted on said shaft on both sides of said horizontal member of said U-shaped support member.

4. A truck as set forth in claim 1, further comprising resilient shock absorbing means operatively coupled between said means for supporting said axle and said means for supporting said axle supporting means.

5. A truck as set forth in claim 1, further comprising a plurality of pairs of aperture means formed in said vertical flanges for permitting selection of a desired position of said axle.

6. An adjustable truck for supporting a pair of wheels which are connected to an axle, said truck adapted to be mounted to the underside of a board, which comprises:

first means for rotatably supporting said axle about a first, substantially vertical pivot axis;

second means coupled to said axle for rotatably supporting same about a second pivot axis which is inclined with respect to said first pivot axis;

third means adapted to be mounted to the underside of said board for supporting said first and second means; and fourth means coupled to said second and third means for adjusting the angle of inclination of said second pivot axis whereby the turning radius of said wheels may be selectively adjusted.

7. The adjustable truck as set forth in claim 6, wherein said second means comprises a yoke having a pair of spaced arms rotatably mounted to said axle.

8. The adjustable truck as set forth in claim 7, wherein said second means further comprises a pivot stud extending from said yoke and defining said second pivot axis.

9. The adjustable truck as set forth in claim 8, wherein said fourth means comprises means for selectively securing said stud to said third means.

10. The adjustable truck as set forth in claim 9, wherein said third means includes a support member having aperture means for receiving said stud and said securing means.

11. The adjustable truck as set forth in claim 6, wherein said first means comprises an axle support bracket having a transverse member, and a substantially vertically oriented shaft defining said first pivot axis and extending through said transverse member for rotatably surrounding same. pg,27

12. The adjustable truck as set forth in claim 11, further comprising resilient bushing means mounted on said shaft on both sides of said transverse member for absorbing shocks.

13. The adjustable truck as set forth in claim 6, wherein said third means comprises a support plate adapted to be fastened on the underside of said board and having a curved portion extending downwardly therefrom and including means for selectively retaining said fourth means.

14. The adjustable truck as set forth in claim 6, wherein said first means comprises an axle support bracket having at least one vertical flange and through which said axle is positioned and a plurality of apertures formed in said flange for permitting selection of a desired position of said axle.

* * * * *